US009534849B2

(12) United States Patent
Kim et al.

(10) Patent No.: US 9,534,849 B2
(45) Date of Patent: Jan. 3, 2017

(54) COOLING MODULE FOR VEHICLE

(71) Applicants: Hyundai Motor Company, Seoul (KR); Doowon Climate Control Co., Ltd., Asan-si (KR); Halla Visteon Climate Control Corp., Daejeon (KR)

(72) Inventors: Jae Yeon Kim, Hwaseong-si (KR); Wan Je Cho, Hwaseong-si (KR); Sang-Ok Lee, Daejeon (KR); Byoung Hoon An, Osan-si (KR); Yoon Sung Kim, Incheon-si (KR); Soon-Jong Lee, Asan-si (KR); Jun-Young Choi, Daejeon (KR); Yong-Nam Ahn, Seoul (KR)

(73) Assignees: Hyundai Motor Company, Seoul (KR); Doowon Climate Control Co., Ltd., Asan-si (KR); Halla Visteon Climate Control Corp., Daejeon (KR)

( * ) Notice: Subject to any disclaimer, the term of this patent is extended or adjusted under 35 U.S.C. 154(b) by 467 days.

(21) Appl. No.: 14/106,752

(22) Filed: Dec. 14, 2013

(65) Prior Publication Data

US 2014/0360703 A1 Dec. 11, 2014

(30) Foreign Application Priority Data

Jun. 7, 2013 (KR) ..... 10-2013-0065503

(51) Int. Cl.
*F28D 1/04* (2006.01)
*F28F 9/02* (2006.01)

(52) U.S. Cl.
CPC ..... *F28D 1/0426* (2013.01); *F28F 9/0234* (2013.01)

(58) Field of Classification Search
CPC .... F28D 1/0426; F28D 1/0435; F28D 1/0461; F28D 9/0234; F28D 2021/0073; F28D 7/0008; B60H 1/3227; B60H 1/00328
(Continued)

(56) References Cited

U.S. PATENT DOCUMENTS 4,227,570 A * 10/1980 Crews ..... F01P 11/08 165/140
5,113,930 A * 5/1992 le Gauyer ..... F28F 9/0075 165/140

(Continued)

FOREIGN PATENT DOCUMENTS

JP 11-192833 A 7/1999
JP 2006-199206 A 8/2006

(Continued)

*Primary Examiner* — Tho V Duong
(74) *Attorney, Agent, or Firm* — Morgan, Lewis & Bockius LLP

(57) ABSTRACT

A cooling module for a vehicle may include a radiator with a first header tank receiving coolant, a second header tank at a predetermined distance from the first header tank to exhaust coolant, and a plurality of tubes that connects the first header tank with the second header tank, and a radiating fin is formed therebetween and at a front side of a vehicle, a water cooled condenser that receives refrigerant through a refrigerant pipe in the second header tank formed by laminating a plurality of plates, which condenses refrigerant by exchanging heat with cooled coolant flowing the second header tank, and an air-cooled condenser connected to the water cooled condenser through the refrigerant pipe, receives first-condensed refrigerant from the water cooled condenser, and is disposed at a front side of the radiator to further condense the refrigerant by exchanging heat with outside air.

10 Claims, 7 Drawing Sheets

(58) Field of Classification Search
USPC ..... 165/140
See application file for complete search history.

(56) References Cited

U.S. PATENT DOCUMENTS

| | | | | | |
|---|---|---|---|---|---|
| 5,121,790 | A * | 6/1992 | Persson | F28D 9/0043 | 165/140 |
| 5,408,843 | A * | 4/1995 | Lukas | B60H 1/3227 | 62/244 |
| 5,537,839 | A * | 7/1996 | Burk | B60H 1/3227 | 165/132 |
| 2004/0094288 | A1* | 5/2004 | Hoyle | F28F 9/0251 | 165/41 |
| 2007/0246201 | A1* | 10/2007 | Hori | F28F 9/0234 | 165/140 |
| 2011/0232868 | A1* | 9/2011 | Iwasaki | F28D 1/0452 | 165/104.13 |

FOREIGN PATENT DOCUMENTS

| | | | |
|---|---|---|---|
| JP | 4970022 | B2 | 4/2012 |
| JP | 2012-127611 | A | 7/2012 |
| KR | 10-2010-0016959 | A | 2/2010 |
| KR | 10-2012-0074052 | A | 7/2012 |
| KR | 10-1173157 | B1 | 8/2012 |

* cited by examiner

COOLING MODULE FOR VEHICLE

CROSS-REFERENCE TO RELATED APPLICATION

The present application claims priority of Korean Patent Application Number 10-2013-0065503 filed Jun. 7, 2013, the entire contents of which application is incorporated herein for all purposes by this reference.

BACKGROUND OF INVENTION

Field of Invention

The present invention is related to a cooling module for a vehicle. More particularly, the present invention relates to a cooling module for a vehicle having a water cooled condenser that is disposed in a header tank of a radiator cooling coolant by exchanging heat with outside air, and an air cooled condenser that is disposed at a front side of the radiator.

Description of Related Art

Generally, an air conditioning unit for a vehicle maintains suitable cabin temperature regardless of ambient temperature and realizes a comfortable indoor environment.

Such an air conditioning unit includes a compressor compressing a refrigerant, a condenser condensing and liquefying the refrigerant compressed by the compressor, an expansion valve quickly expanding the refrigerant condensed and liquefied by the condenser, and an evaporator evaporating the refrigerant expanded by the expansion valve such that cooling air is supplied to the cabin in which the air conditioning unit is installed by using evaporation latent heat.

However, when a coolant condenser is applied to condense the refrigerant in a conventional air conditioning system as described above, the coolant is cooled by the condenser and the refrigerant temperature of the outlet of the condenser is increased, and therefore there is a problem that the power consumption is increased.

Also, because heat capacity of the coolant condenser is larger than that of an air cooled condenser, the condensing pressure is reduced, and because a temperature difference between the coolant and the refrigerant is small and the coolant temperature is higher compared with ambient air, it is hard to realize subcooling and therefore there is a drawback that overall cooling performance is deteriorated.

A large capacity cooling fan and radiator are necessary so as to prevent this, so the layout becomes disadvantageous in a narrow engine compartment and there is a drawback that overall weight and cost are increased.

Also, a coolant condenser that is disposed in a narrow engine compartment is to be disposed at a rear side of a fender or an engine compartment and it is hard to secure a space, and therefore the layout and the piping thereof are complicated, the assembly and mounting characteristics are deteriorated, the performance is deteriorated by the heat of the engine compartment, and the flow resistance of the coolant is increased to increase the power consumption of the compressor.

Further, in an environmentally friendly vehicle having a motor, an electric power component, and a stack, the coolant cools the constituent elements and then is supplied to the condenser and the temperature thereof is increased, and therefore there is a problem that the condensing capacity of the coolant is deteriorated.

The information disclosed in this Background section is only for enhancement of understanding of the general background of the invention and should not be taken as an acknowledgement or any form of suggestion that this information forms the prior art already known to a person skilled in the art.

BRIEF SUMMARY

Various aspects of the present invention provide for a cooling module for a vehicle having advantages of reducing a condensing pressure for condensing refrigerant, increasing condensing performance of refrigerant, and increasing cooling performance by applying a water cooled condenser using coolant as a heat exchanging media in a header tank of a radiator and an air cooled condenser using outside air as a heat exchanging media at a front side of a radiator.

Also, the present invention has been made in an effort to provide a cooling module for a vehicle having advantages of forming a water cooled condenser and an air cooled condenser on a radiator in such a way that a package performance is improved and space usage efficiency is increased.

Various aspects of the present invention provide for a cooling module for a vehicle that may include a radiator that includes a first header tank receiving coolant, a second header tank that is disposed with a predetermined distance from the first header tank to exhaust coolant, and a plurality of tubes that connects the first header tank with the second header tank, are disposed with an equal gap from each other, and a radiating fin is formed therebetween and is disposed at a front side of a vehicle, a water cooled condenser that receives refrigerant through a refrigerant pipe, is disposed in the second header tank, is formed by laminating a plurality of plates, and condenses refrigerant by exchanging heat with cooled coolant flowing the second header tank, and an air-cooled condenser that is connected to the water cooled condenser through the refrigerant pipe, receives first-condensed refrigerant from the water cooled condenser, and is disposed at a front side of the radiator to further condense the refrigerant by exchanging heat with outside air.

An inlet may be formed on the first header tank to receive coolant, and an outlet corresponding to the inlet may be formed on the second header tank to exhaust the coolant.

The inlet and the outlet may be disposed at an opposite side of the first header tank and the second header tank.

The water cooled condenser may include a condensing portion that two plates are combined to form one refrigerant passage, and the refrigerant passages are disposed with a predetermined distance from each other, a refrigerant inlet that is formed at one end of the condensing portion to be connected to the refrigerant passage and is connected to the refrigerant pipe at an outside of the second header tank, and a refrigerant outlet that is formed at the other end of the condensing portion corresponding to the refrigerant inlet to be connected to the refrigerant passage, and is connected to the refrigerant pipe at an outside of the second header tank.

A plurality of protrusions may be formed on an outside surface of a plate that is disposed at one side among two plates with a predetermined distance, and the protrusions may contact an outside surface of the plate that is disposed at the other side thereof to be combined.

A radiating protrusion may integrally protrude toward both sides in a width direction of the condensing portion on the plate that is disposed at the other side of two plates.

The air cooled condenser may be disposed on a front side of the radiator in a length direction.

The air cooled condenser may have a plurality of coolant tubes that are disposed with an equal distance and is a fin tube type heat exchanger that a radiating fin is formed between the coolant tubes.

The air cooled condenser may be divided in a height direction to sequentially condense depending on the condition of the refrigerant that is supplied from the water cooled condenser.

A receiver dryer may be integrally formed with the air cooled condenser to separate gaseous refrigerant inside the refrigerant.

A receiver dryer may be disposed on the radiator to separate gaseous refrigerant of the refrigerant that is condensed passing the air cooled condenser in a width direction of a vehicle and connects the air cooled condenser with the refrigerant pipe.

A receiver dryer may be disposed at one side of the radiator in a width direction of a vehicle, be disposed on the refrigerant pipe between the water cooled condenser and the air cooled condenser, and separate gaseous refrigerant inside the refrigerant condensed by the water cooled condenser.

The water cooled condenser may be coupled in series with the air cooled condenser through the receiver dryer.

As described above, in a cooling module for a vehicle according to various aspects of the present invention, a water cooled condenser that uses coolant as a heat exchanger media in a header thank of a radiator is applied and an air cooled condenser that uses outside air as a heat exchanger media is applied to a front side of a radiator such that condensing pressure is reduced, condensing performance is increased, and cooling performance is improved while refrigerant is condensed.

Also, because a radiator is an integrated type having a water cooled condenser and an air cooled condenser, a package performance is improved, because a layout of a narrow engine compartment is simplified, a space usage efficiency is increased, weight is reduced, and manufacturing cost is also saved.

Also, because a condensing pressure is reduced and a condensing performance is improved, necessary work can be reduced, and therefore overall fuel consumption efficiency of a vehicle is improved.

And, because a water cooled condenser is disposed inside a header tank stores cooled coolant, there is an effect that coolant efficiently exchanges heat with refrigerant therein.

The methods and apparatuses of the present invention have other features and advantages which will be apparent from or are set forth in more detail in the accompanying drawings, which are incorporated herein, and the following Detailed Description, which together serve to explain certain principles of the present invention.

DETAILED DESCRIPTION

Reference will now be made in detail to various embodiments of the present invention(s), examples of which are illustrated in the accompanying drawings and described below. While the invention(s) will be described in conjunction with exemplary embodiments, it will be understood that present description is not intended to limit the invention(s) to those exemplary embodiments. On the contrary, the invention(s) is/are intended to cover not only the exemplary embodiments, but also various alternatives, modifications, equivalents and other embodiments, which may be included within the spirit and scope of the invention as defined by the appended claims.

In the specification, unless explicitly described to the contrary, the word "comprise" and variations such as "comprises" or "comprising" will be understood to imply the inclusion of stated elements but not the exclusion of any other elements.

Also, terms ". . . unit", ". . . means", ". . . portion", and ". . . element" that are mentioned in the specification signify units of comprehensive configuration that performs at least one function or operation.

Figure 1:
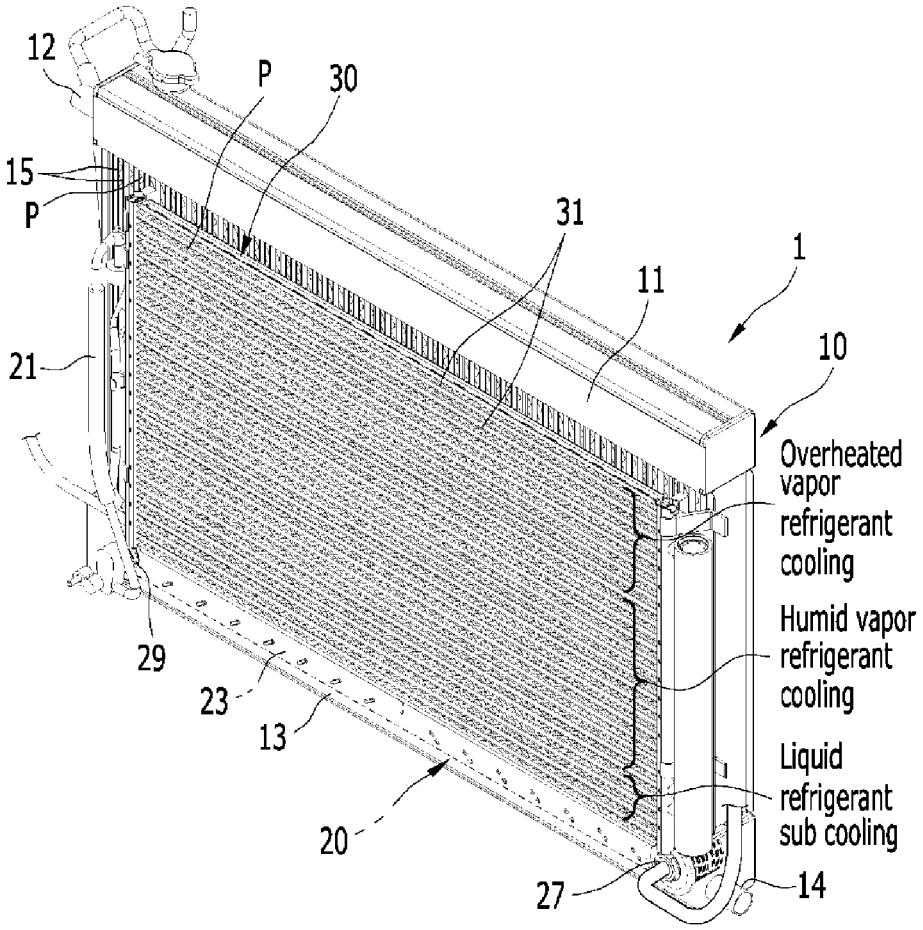
FIG. 1 is a projective perspective view of an exemplary cooling module for a vehicle according to the present invention.
Figure 2:
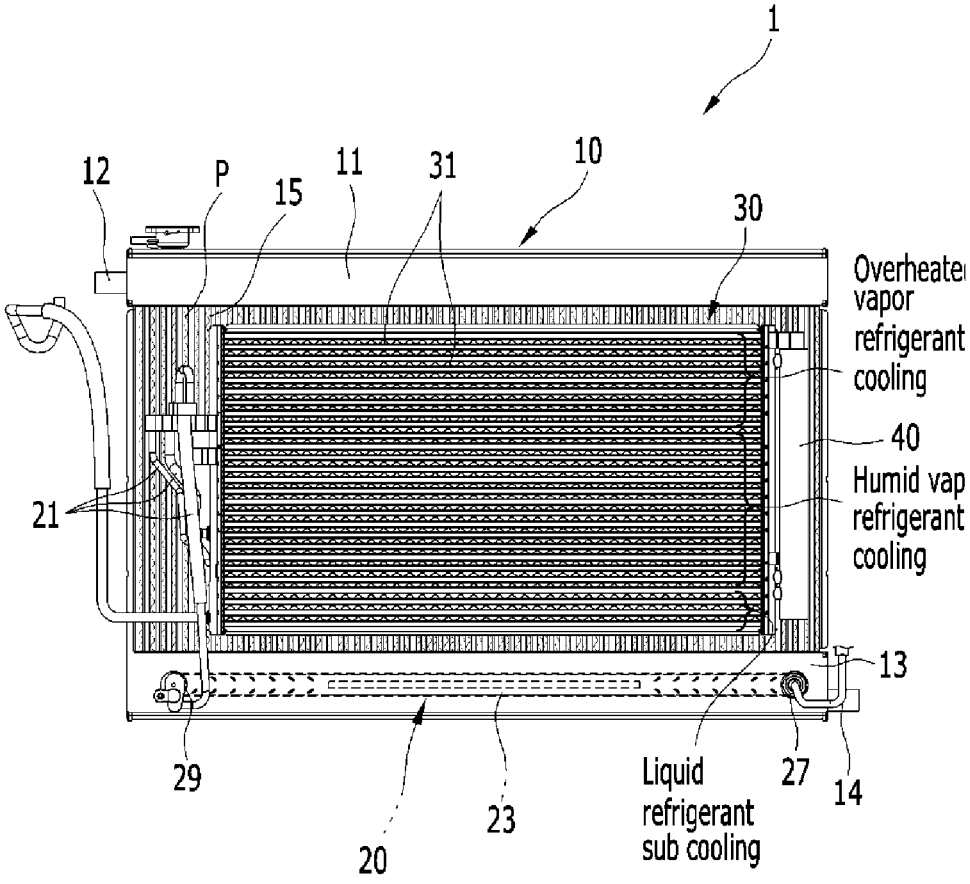
FIG. 2 is a projective front view of an exemplary cooling module for a vehicle according to the present invention.
Figure 3:
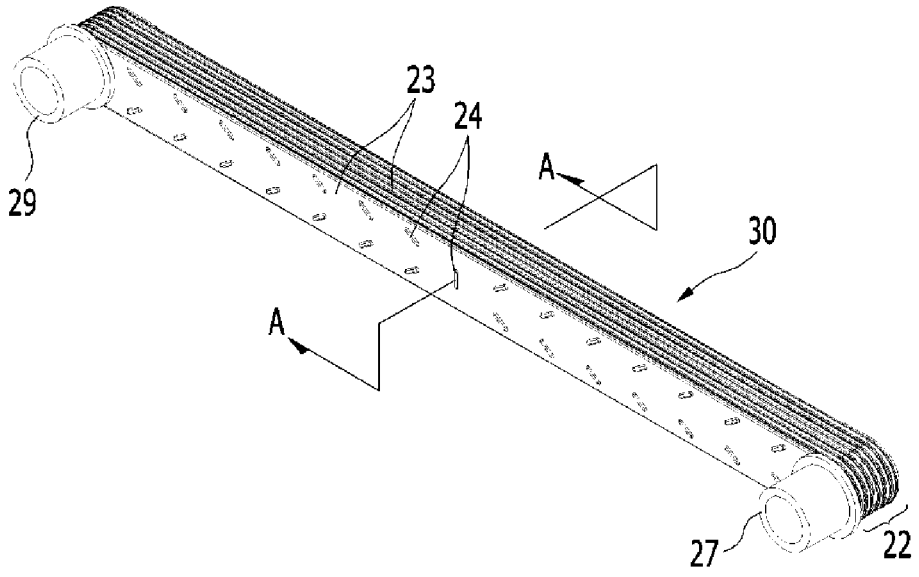
FIG. 3 is a perspective view of a water cooled condenser that is applied to an exemplary cooling module for a vehicle according to the present invention.
Figure 4:
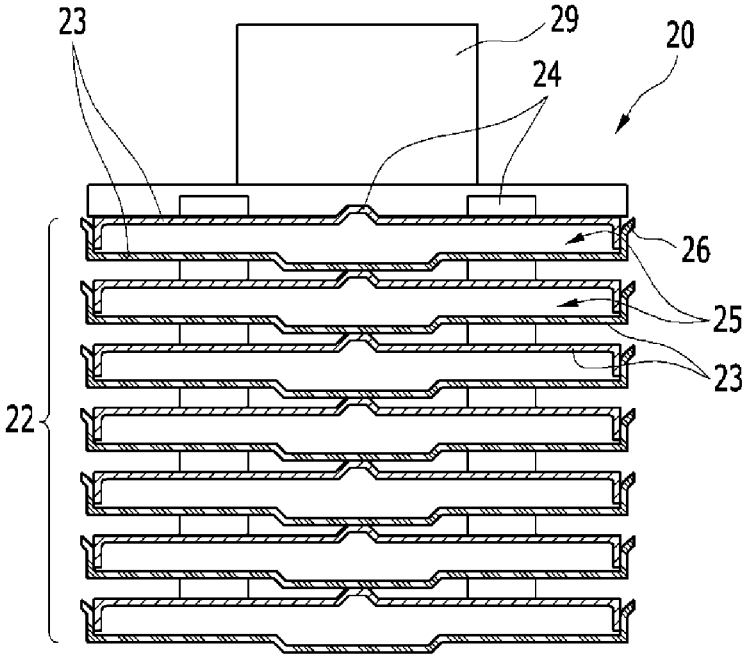
FIG. 4 is a cross-sectional view along A-A line of FIG. 3.

FIG. 1 is a projective perspective view of a cooling module for a vehicle according to various embodiments of the present invention, FIG. 2 is a projective front view of a cooling module for a vehicle according to various embodiments of the present invention, FIG. 3 is a perspective view of a water cooled condenser that is applied to a cooling module for a vehicle according to various embodiments of the present invention, and FIG. 4 is a cross-sectional view along A-A line of FIG. 3.

Referring to drawings, a cooling module for a vehicle 1 according to various embodiments of the present invention has a water cooled condenser 20 using coolant as heat exchange media inside a header tank of a radiator 10 and an air cooled condenser 30 using outside air as heat exchange media at a front side of a radiator 10 in such a way that condensing pressure is reduced, condensing performance is improved, and cooling performance is enhanced.

Also, because the cooling module 1 applies the water cooled condenser 20 and the air cooled condenser 30 to the radiator 10, a package performance is improved and space usage efficiency is also improved.

For this, a cooling module for a vehicle 1 according to various embodiments of the present invention, as shown in FIG. 1 and FIG. 2, includes a radiator 10, a water cooled condenser 20, and an air cooled condenser 30.

Firstly, the radiator 10 is disposed at a front side of a vehicle, and heated coolant that cools an engine or electronic devices flows through the radiator 10. The coolant flows in the radiator 10 to be cooled by outside air during a driving of a vehicle.

Here, a cooling fan is disposed at a rear side of the radiator 10 to supply the radiator 10 with outside air in such a way that the coolant is efficiently cooled.

The radiator 10 performing the above function includes a first header tank 11 receiving coolant, a second header tank 13 that is disposed with a predetermined distance from the first header tank 11 to exhaust the coolant, and a plurality of tubes 15 that connects the first header tank 11 with the second header tank 13, is disposed with an equal distance from each other, and a radiating fin P is disposed thereon.

That is, in the radiator 10, the heated coolant that flows in the first header tank 11 passes the tube 15 to be cooled by outside air, and the cooled coolant is exhausted through the second header tank 13.

Here, an inlet 12 is formed to receive coolant on the first header tank 11, and an outlet 14 corresponding to the inlet 12 is formed to exhaust coolant on the second header tank 13.

The inlet 12 and the outlet 14 can respectively formed at an opposite side on the first header tank 11 and the second header tank 13, and they are respectively disposed at both sides based on a width direction of a vehicle on the first header tank 11 that is disposed at an upper side and the second header tank 13 that is disposed at a lower side in various embodiments.

The radiator 10 having this configuration is a fin-tube type heat exchanger, wherein the coolant flows through the first header tank 11, the tube 15, and the second header tank 13 and is cooled by exchanging heat with outside air.

Here, the radiating fin (P) is formed between the tubes 15 and the heat that is transmitted from the coolant flowing the tube 15 is radiated to the outside.

Meanwhile, in various embodiments, It is described that the first and the second header tanks 11 and 13 are disposed at an upper portion and a lower portion of the radiator 10 as various embodiments, it is not limited thereto, and the first and the second header tanks 11 and 13 can be disposed at both sides of the radiator 110 based on a width direction of a vehicle to be connected by the tube 116.

In various embodiments, the water cooled condenser 20, as shown in FIG. 3 and FIG. 4, receives refrigerant through a refrigerant pipe 21 and is formed by a plurality of plates 23 that is laminated inside the second header tank 13 receiving coolant that is cooled by the radiator 10.

The water cooled condenser 20 exchanges heat with cooled coolant that flows in the second header tank 13 to condense refrigerant.

Here, the water cooled condenser 20 includes a condensing portion 22, a refrigerant inlet 27, and a refrigerant outlet 29, and hereinafter these will be described.

Firstly, two plates 23 are combined to form one set as a refrigerant passage 25 in the condensing portion 22 and several sets of two plates 23 are prepared, and several passages 25 are disposed with a predetermined distance.

Here, the condensing portion 22 can have 7 sets of refrigerant passages 25 those are formed by combining two plates 23, wherein 7 sets of refrigerant passages can be laminated.

The refrigerant inlet 27 is formed at one end of the condensing portion 22 to be connected to the refrigerant passage 25 and is connected to the refrigerant pipe 21 at an outside of the second header tank 13.

And, the refrigerant outlet 29 corresponding to the refrigerant inlet 27 is formed at the other side of the condensing portion 22 to be connected to the refrigerant passage 25 and is connected to the refrigerant pipe 21 at an outside of the second header tank 14.

Here, one plate 23 that is disposed at one side of two plates 23 has a plurality of protrusions 24 that are formed at one side with a predetermined distance and the other plate 23 that is disposed at the other side contacts one plate 23 through each protrusion 24.

That is, the protrusion 24 is formed on an upper surface of the plate 23 that is disposed on an upper side based on the drawing in various embodiments, and the upper side plate 23 is combined with the lower side plate 23 through the protrusion 24 in such a way that two plates 23 are securely combined with each other.

Also, when the coolant that flows in the second header tank 13 flows spaces that is formed by each protrusion 24, the flowing path of the coolant is continuously changed by the protrusion 24 such that the heat exchange between the coolant and the refrigerant is efficiently performed and the condensing rate of the refrigerant is enhanced.

Meanwhile, a radiating protrusion 26 is integrally formed at the plate 23 that is disposed at the other side of two plates 23, and the radiating protrusion 26 is formed toward an outside at both sides in a width direction of the condensing portion 22 in various embodiments. One will appreciate that such integral components may be monolithically formed.

The radiating protrusion 26 makes the heat of refrigerant passing the refrigerant passage 25 of the water cooled condenser 20 be efficiently exchanged with coolant inside the second header tank 13.

Figure 5:
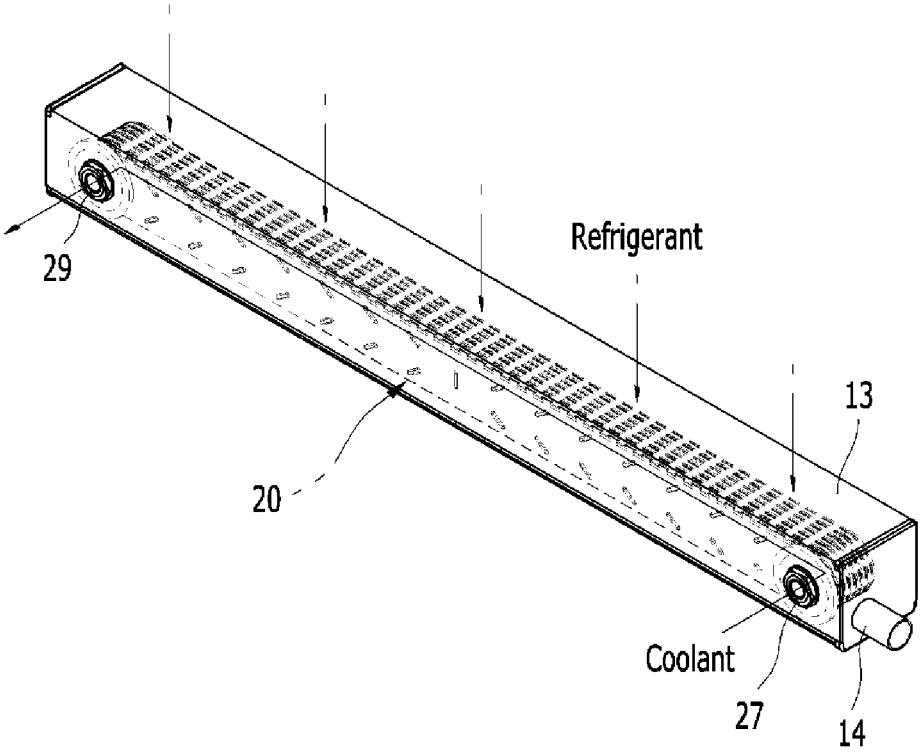
FIG. 5 is a drawing showing coolant flowing in an exemplary second header tank and refrigerant flowing passing an exemplary water cooled condenser according to the present invention.

FIG. 5 is a drawing showing coolant flowing in a second header tank and refrigerant flowing passing a water cooled condenser according to various embodiments of the present invention.

That is, the water cooled condenser 20 having the above configuration, as shown in FIG. 5, enables coolant to flow a gap between two plates 23 and the protrusion 24 generates flowing resistance to increase contact area with the plate 23 such that refrigerant passing the refrigerant passage 25 efficiently exchanges heat with coolant and condensing efficiency of refrigerant is enhanced.

Also, the radiating protrusion 26 transmits the heat that is transmitted from the refrigerant passing the refrigerant passage 25 to the coolant flowing inside the second header tank 13.

Meanwhile, in various embodiments, it is described that the water cooled condenser 20 is disposed in the second head tank 13 that is disposed at a lower side of the first header tank 11 as various embodiments, but it is not limited thereto, the water cooled condenser 20 can be disposed in a header tank receiving cooled coolant among both sides header tanks in a cross flow type that are disposed at both sides of the radiator 10.

And, the air cooled condenser 30 is connected to the water cooled condenser 20 through the refrigerant pipe 21, receives first-condensed refrigerant from the water cooled condenser 20, and is disposed at a front side of the radiator 10 to further condense the refrigerant by exchanging heat with outside air.

Here, the air cooled condenser 30 can be disposed in a length direction at a front side of the radiator 10, a plurality of coolant tubes 31 are disposed therein with an equal distance from each other, and this is a fin-tube type having a radiating fin (P) between the coolant tubes 31.

The air cooled condenser 30 can be separated in a height direction so as to sequentially condense the refrigerant that is supplied from the water cooled condenser 20 depending on the state of the refrigerant.

For example, in a case in which the air cooled condenser 30 is separated into three step in various embodiments, when the refrigerant is supplied from the water cooled condenser 20, over heated vapor refrigerant is condensed at an upper portion, humid vapor refrigerant is condensed at a middle portion, and liquid refrigerant is sub cooled at a lower portion.

The air cooled condenser 30 as described above is connected to the air cooled condenser 20 through the refrigerant pipe 21 at one side of a width direction of a vehicle, and a receiver dryer 40 that separates gaseous refrigerant from condensed refrigerant can be integrally formed thereon.

Figure 6:
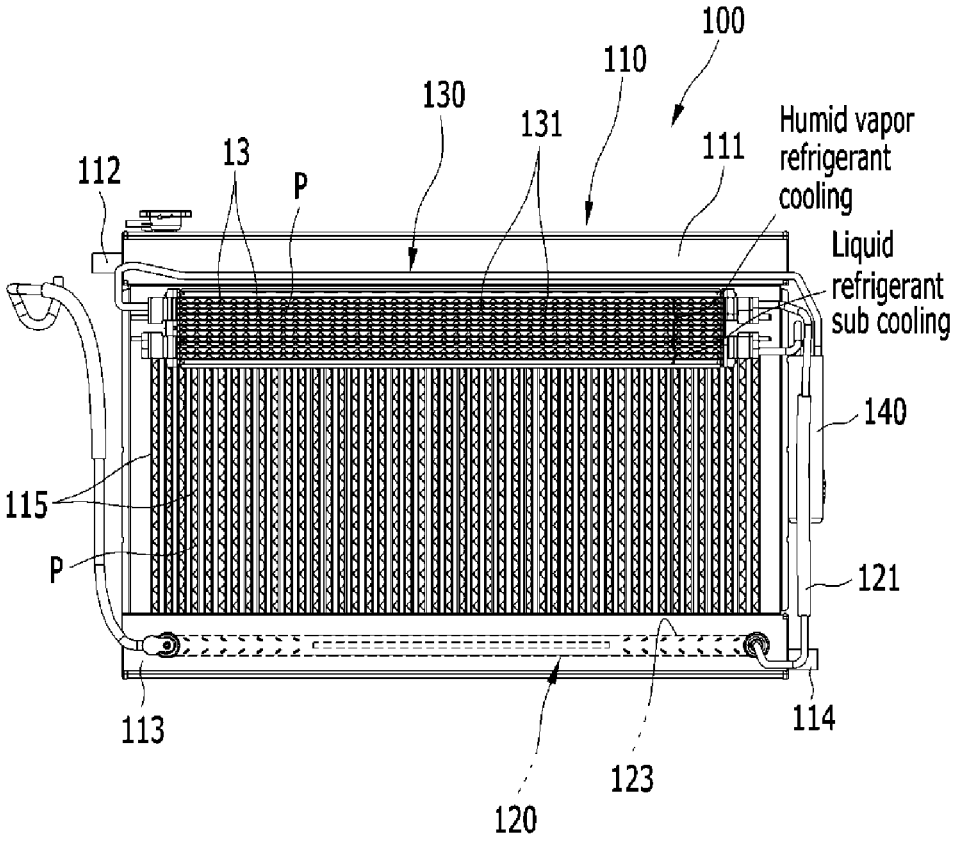
FIG. 6 is a projective front view of an exemplary cooling module for a vehicle according to the present invention.

FIG. 6 is a projective front view of a cooling module for a vehicle according to various embodiments of the present invention.

Referring to FIG. 6, in a cooling module for a vehicle 100 according to various embodiments of the present invention, in a case in which the air cooled condenser 120 is divided into two step, humid vapor refrigerant is cooled to be condensed at an upper portion and liquid refrigerant is sub cooled to be condensed at a lower portion.

Here, a receiver dryer 140 is disposed at one side of the radiator 110 of a width direction of a vehicle so as to separate gaseous refrigerant from the refrigerant that is condensed by the air cooled condenser 120 and is connected to the air cooled condenser 120 through the refrigerant pipe 121.

Figure 7:
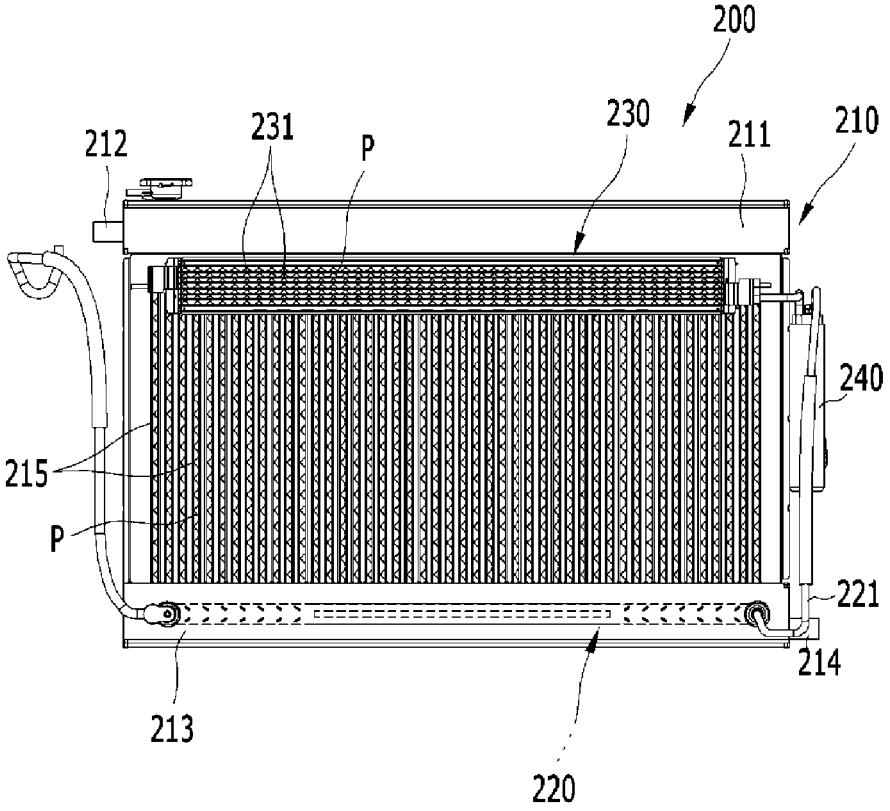
FIG. 7 is a projective front view of an exemplary cooling module for a vehicle according to the present invention.

FIG. 7 is a projective front view of a cooling module for a vehicle according to various embodiments of the present invention.

Referring to FIG. 7, in a cooling module for a vehicle 200 according to various embodiments of the present invention, the air cooled condenser 220 is not divided, a receiver dryer 240 is disposed at one side of the radiator 210 of a width direction of a vehicle, is disposed on the refrigerant pipe 221 between the water cooled condenser 220 and the air cooled condenser 230, and separates gaseous refrigerant from the refrigerant that is condensed from the water cooled condenser 220.

Here, the water cooled condenser 220 is coupled in series with the air cooled condenser 230 through the receiver dryer 240.

Accordingly, the liquid state refrigerant that is exhausted from the water cooled condenser 220 and gaseous refrigerant thereof is separated by the receiver dryer 240 is supplied to the air cooled condenser 230 and the liquid state refrigerant is further condensed by the air cooled condenser 230 through heat exchange with outside air.

That is, as described above, the receiver dryer (40, 140, 240) is integrally formed at one side of the air cooled condenser 30 or is integrally formed at one side of the radiator 110 and 210 based on a width direction of a vehicle.

Accordingly, a cooling module for a vehicle (1, 100, 200) according to various embodiments uses coolant that the heat transfer coefficient thereof is larger than outside air to condense refrigerant through the water cooled condenser (20, 120, 220) in such a way that condensing pressure of refrigerant generated inside is reduced.

And, the air cooled condenser (30, 130, 230) receives condensed refrigerant that passes the water cooled condenser (20, 120, 220), has separated areas that respectively condenses refrigerant depending on the state of the refrigerant, and exhausts this to the receiver dryer (40, 140), and further receives liquid refrigerant that gaseous refrigerant is separated from the receiver dryer (40, 140) and can further condenses the liquid refrigerant.

Also, according to various embodiments of the present invention, after refrigerant that is exhausted from the water cooled condenser 220 passes the receiver dryer 240, the air cooled condenser 230 receives the liquid state refrigerant to be able to cool the refrigerant through outside air.

Accordingly, the air cooled condenser (30, 130, 230) can increase a temperature difference of refrigerant from outside to realize sub cool and can reduce total heat transfer of the refrigerant pipe (21, 121, 221).

A cooling module for a vehicle (1, 100, 200) according to various embodiments of the present invention as described above reduces condensing pressure as a merit of a water cooled type and realizes a sub cool as a merit of an air cooled type to compensate drawbacks thereof, and the water cooled condenser (20, 120, 220) and the air cooled condenser (30, 130, 230) are integrally prepared at a front side of the radiator (10, 110, 210) and inside of the second header tank (13, 113, 213) in such a way that the space usage efficiency is improved in an engine compartment and the size thereof becomes compact.

Accordingly, in a cooling module (1, 100, 200) for a vehicle according to various embodiments of the present invention, a water cooled condenser (20, 120, 220) that uses coolant as a heat exchanger media in a header thank (13, 113, 213) of a radiator (10, 110, 210) is applied and an air cooled condenser (30, 130, 230) that uses outside air as a heat exchanger media is applied to a front side of a radiator (10, 110, 210) such that condensing pressure is reduced, condensing performance is increased, and cooling performance is improved while refrigerant is condensed.

Also, because a radiator (10, 110, 210) is an integrated type having a water cooled condenser (20, 120, 20) and an air cooled condenser (30, 130, 230), a package performance is improved, because a layout of a narrow engine compartment is simplified, a space usage efficiency is increased, weight is reduced, and manufacturing cost is also saved.

Also, because a condensing pressure is reduced and a condensing performance is improved, necessary work can be reduced, and therefore overall fuel consumption efficiency of a vehicle is improved.

And, because a water cooled condenser (20, 120, 220) is disposed inside a second header tank (13, 113, 213) stores cooled coolant, there is an effect that coolant efficiently exchanges heat with refrigerant therein.

For convenience in explanation and accurate definition in the appended claims, the terms upper or lower, front, and etc. are used to describe features of the exemplary embodiments with reference to the positions of such features as displayed in the figures.

The foregoing descriptions of specific exemplary embodiments of the present invention have been presented for purposes of illustration and description. They are not intended to be exhaustive or to limit the invention to the precise forms disclosed, and obviously many modifications and variations are possible in light of the above teachings. The exemplary embodiments were chosen and described in order to explain certain principles of the invention and their practical application, to thereby enable others skilled in the art to make and utilize various exemplary embodiments of the present invention, as well as various alternatives and modifications thereof. It is intended that the scope of the invention be defined by the Claims appended hereto and their equivalents.

What is claimed is:

1. A cooling module for a vehicle, comprising:

a radiator including a first header tank receiving coolant, a second header tank disposed at a predetermined distance from the first header tank to exhaust coolant, and a plurality of tubes that connects the first header tank with the second header tank, are disposed with an equal gap from each other, and a radiating fin is formed therebetween and is disposed at a front side of the vehicle;

a water cooled condenser that receives refrigerant through a refrigerant pipe, is disposed in the second header tank, is formed by laminating a plurality of plates, and condenses refrigerant by exchanging heat with cooled coolant flowing the second header tank; and an air-cooled condenser connected to the water cooled condenser through the refrigerant pipe, which receives first-condensed refrigerant from the water cooled condenser, and is disposed at a front side of the radiator to further condense the refrigerant by exchanging heat with outside air, wherein a receiver dryer is disposed at one side of the radiator in a width direction of the vehicle, is disposed on the refrigerant pipe between the water cooled condenser and the air cooled condenser, and separates gaseous refrigerant inside the refrigerant condensed by the water cooled condenser.

2. The cooling module for a vehicle of claim 1, wherein an inlet is formed on the first header tank to receive coolant, and an outlet corresponding to the inlet is formed on the second header tank to exhaust the coolant.

3. The cooling module for a vehicle of claim 2, wherein the inlet and the outlet are disposed on the first header tank and the second header tank, respectively, and the first header tank and the second header tank are disposed opposite to each other.

4. The cooling module for a vehicle of claim 1, wherein the water cooled condenser includes:

a condensing portion that two plates are combined to form one refrigerant passage, and the refrigerant passages are disposed a predetermined distance from each other;

a refrigerant inlet formed at one end of the condensing portion to be connected to the refrigerant passage, and connected to the refrigerant pipe at an outside of the second header tank; and a refrigerant outlet formed at a second end of the condensing portion corresponding to the refrigerant inlet to be connected to the refrigerant passage, and connected to the refrigerant pipe at an outside of the second header tank.

5. The cooling module for a vehicle of claim 4, wherein a plurality of protrusions are formed on an outside surface of a plate disposed at a first side among two plates with a predetermined distance, and the protrusions contacts an outside surface of the plate disposed at a second side thereof to be combined.

6. The cooling module for a vehicle of claim 5, wherein a radiating protrusion integrally protrudes toward an outside of the two plates from both sides of the two plates in a width direction of the condensing portion on the plate disposed at the second side of the two plates.

7. The cooling module for a vehicle of claim 1, wherein the air cooled condenser is disposed on a front side of the radiator in a length direction.

8. The cooling module for a vehicle of claim 1, wherein the air cooled condenser has a plurality of coolant tubes that are disposed with an equal distance and is a fin tube type heat exchanger that a radiating fin is formed between the coolant tubes.

9. The cooling module for a vehicle of claim 1, wherein the air cooled condenser is divided in a height direction to sequentially condense depending on the condition of the refrigerant supplied from the water cooled condenser.

10. The cooling module for a vehicle of claim 1, wherein the water cooled condenser is coupled in series with the air cooled condenser through the receiver dryer.

* * * * *